US005168925A

United States Patent [19]

Suzumura et al.

[11] Patent Number: 5,168,925

[45] Date of Patent: Dec. 8, 1992

[54] HEAT EXCHANGER

[75] Inventors: Keiji Suzumura, Toyota; Hiroshi Okazaki, Kariya, both of Japan

[73] Assignee: Aisin Seiki Kabushiki Kaisha, Kariya, Japan

[21] Appl. No.: 799,154

[22] Filed: Nov. 27, 1991

[30] Foreign Application Priority Data

Nov. 30, 1990 [JP] Japan ..... 2-333659

[51] Int. Cl.[5] ..... F28D 1/53

[52] U.S. Cl. ..... 165/176; 165/146; 165/174

[58] Field of Search ..... 165/146, 147, 174–176

[56] References Cited

U.S. PATENT DOCUMENTS 4,330,034 5/1982 Lang et al. ..... 165/113
4,825,941 5/1989 Hoshino et al. ..... 165/110

FOREIGN PATENT DOCUMENTS 725047 1/1966 Canada ..... 165/176
62-153685 7/1987 Japan ..... 165/176
63-3191 1/1988 Japan ..... 165/176
63-3192 1/1988 Japan ..... 165/176

*Primary Examiner*—Allen J. Flanigan
*Attorney, Agent, or Firm*—Burns, Doane, Swecker & Mathis

[57] ABSTRACT

A heat exchanger includes a plurality of tube elements, and a plurality of fins which are alternately stacked together with the tube elements. A tank element is disposed on both sides of the tube elements. At least one of the tank elements is formed of brazing materials and comprises a pair of plates which are U-shaped in cross-section and form an inner space. A partition plate is positioned in the inner space and divides the inner space into a first space adjacent the tube elements and a second space separated from the tube elements by the first space. The partition plate is also provided with a penetrating hole. Each of the tube elements contain at least first and second coolant flow passages. The first coolant flow passages extend through the penetrating holes and into the second space, and the second coolant flow passages extend into the first passage.

5 Claims, 4 Drawing Sheets

HEAT EXCHANGER

BACKGROUND OF THE INVENTION

1. Field of the Invention

This invention relates to a heat exchanger, and more particularly to a heat exchanger which is used as a condenser installed in an air conditioner for an automobile and the like.

2. Description of the Related Art

In FIG. 5 and FIG. 6 which show conventional heat exchanger, fins 5 and tube elements 6 are alternately stacked together. First and second tank elements 3, 4 are installed on both sides of the fins 5 and the tube elements 6. The coolant, before flowing into the heat exchanger, is high temperature steam. At first the coolant flows into an entrance 1 and inlet pipe 2 and runs in an inner space 3*d* of first tank element 3, which is divided by partition wall 9. After that it runs through the tube elements 6 and each inner space 4*d*, 3*e*, 4*e* of the first and second tank element 3, 4, as shown by arrows 6A, 6B, 6C, and flows through outlet pipe 7 and outlet pipe 8.

The coolant flow exchanges heat with cooling air-flow shown as an arrow 15 through the surface of the tube elements 6 and the fins 5. As a result of this heat exchange, the heat of the coolant flow is removed by the cooling air-flow. As the coolant flow is cooled, it is compressed and liquefies, and its volume decreases. Considering the decrease of the volume of the coolant flow, the total cross-sectional area of the tube elements 6 needed to carry the coolant flow becomes smaller as the coolant flow runs from the entrance to the exit as shown in FIG. 5. In general, the tube elements 6 and the tank elements 3 are formed by extrusion molding. They are constructed and soldered to the fins 5.

The heat exchanger shown in FIG. 5 is a an orthogonal flow type, namely the coolant flow intersects at right angles with the cooling air flow. Though the shape of the orthogonal flow type is compact, the heat exchange efficiency is less than that of the opposite flow type (the coolant in the opposite flow type flows opposite to the cooling air flow) in general. Because the heat of the coolant is removed and the temperature of the coolant goes down between the upper reaches and the lower reaches of the exchanges, the difference between the two flows is slowly reduced.

SUMMARY OF THE INVENTION

It is an object of the invention to provide an improved heat exchanger which obviates the above conventional drawbacks.

It is another object of the invention to provide an improved heat exchanger which is highly efficient and, which is easy to construct and in a short time.

In order to attain the foregoing objects, a heat exchanger of this invention is formed by alternately stacking together tube elements having coolant flow passages therein and fins. It performs a heat exchange between air flows and coolant flows which are supplied into the coolant flow passages through a pair of tank elements which are disposed on both sides of the tube elements.

One of the tank elements is formed of brazing materials and comprises a pair of plates which have a sectional U shape. A pair of such plates are connected to form an inner space. Between the plates partition plates are brazed. They divide the inner space into an inside space near the tube elements and an outside space near the inside space, and they have penetrating holes.

The tube elements comprises first coolant flow passages which project from the penetrating hole to the outside space and second coolant flow passages whose end portions communicate with the inside space. One of the first and second coolant flow passages is situated higher than the other coolant flow passage and on the rear side of the air flow.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which;

FIG. 1 is a front view showing a heat exchanger according to this invention from a direction that air flows to;

FIG. 2(*b*) is a cross sectional view taking along line 2*b*—2*b* in FIG. 1;

FIG. 5 is a front view showing a heat exchanger according to the prior art from a direction that air flows to.

DESCRIPTION OF THE PREFERRED EMBODIMENTS

Figure 1:
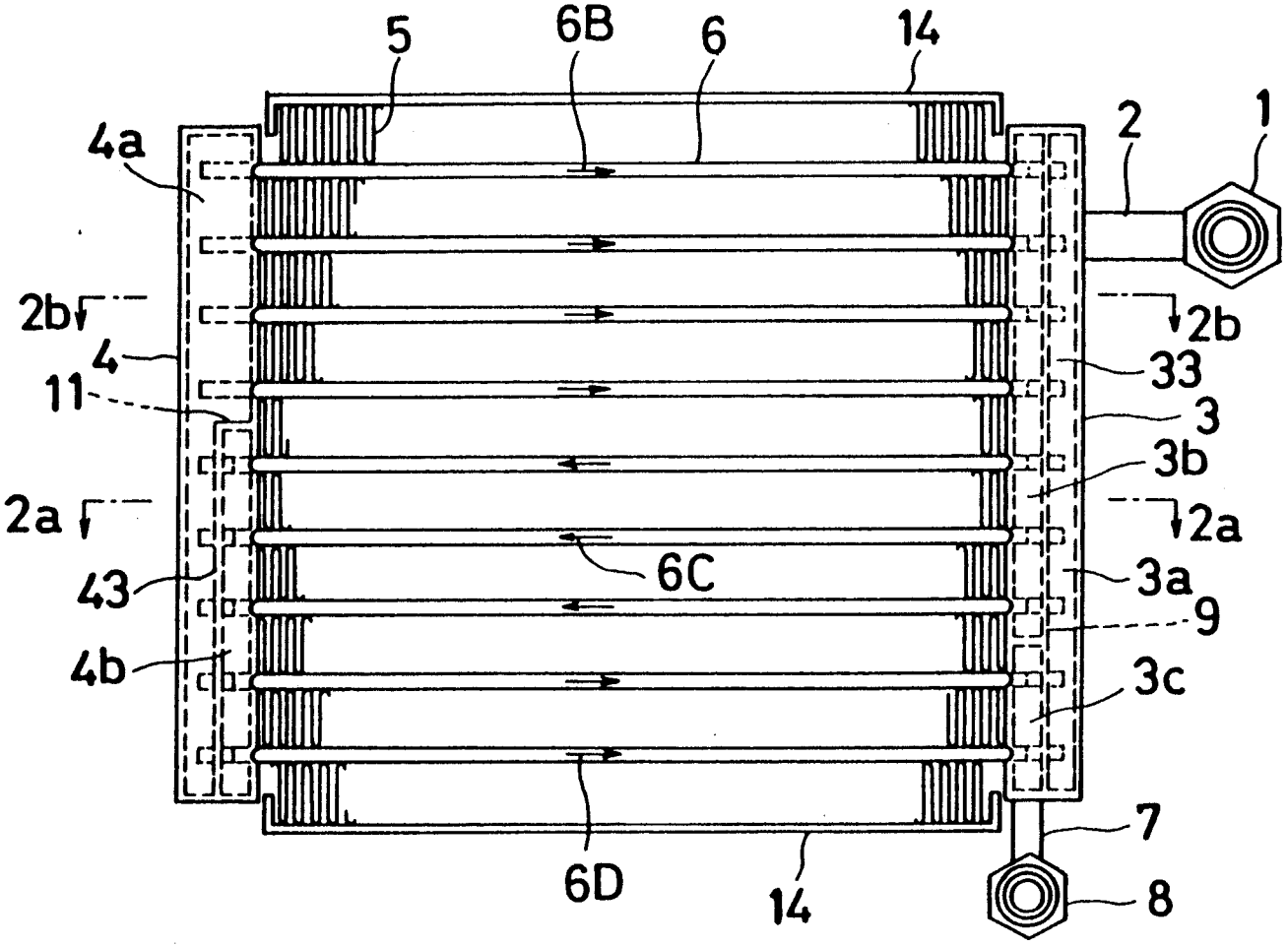
Figure 2A:
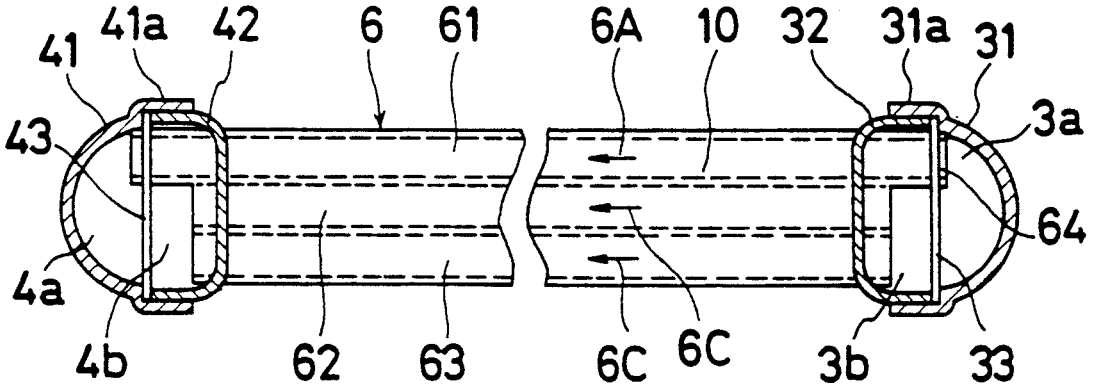
FIG. 2(*a*) is a cross sectional view taking along line 2*a*—2*a* FIG. 1.
Figure 2B:
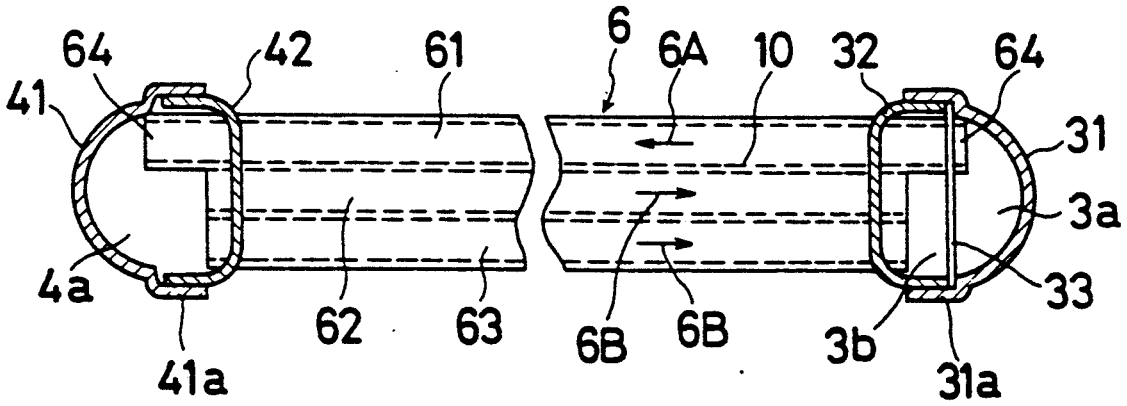

Referring to FIG. 1, FIG. 2(*a*) and FIG. 2(*b*), the heat exchanger of this invention is formed as following. Tube elements 6 and fins 5 formed as corrugated fins are alternately stacked together and side plates 14 are installed on an upper surface and a lower surface of the laminated product.

A pair of tank elements 3, 4 are attached on both sides of each passage of the tube elements 6. As shown in FIG. 2(*a*) and FIG. 2(*b*), the tank elements 3, 4 are formed of outside plates 31, 41 and inside plates 32, 42 which are made by press fitting. The outside plates 31, 41 and the inside plates 32, 42 make an inner space therein. Each plate is formed of brazing sheet material which is made of brazed aluminum. The outside surfaces of the inside plates 32, 42 which in a cross sectional view are U shaped are fixed in the inner surface of the outside plates 31, 41 which also have a cross sectional U shape.

Partition plates 33, 43 made of brazing sheet material are fitted in the middle between the inside plates 32, 42 and the outside plates 31, 41. The partition plates 33, 43 are fixed in each plate by brazing and each partition plate has a hole into which is fixed a projecting part of a tube element 4. The inner space of each tank element is divided into inside spaces 3*b*, 3*c*, 4*b* which are near the tube element 6 and outside spaces 3*a*, 4*a* which are far from the tube element 6. The outside space 3*a* of the first tank element 3 communicates with inlet pipe 2. The inside space 3*b*, 3*c* of the first tank element 3 is divided by partition wall 9. The edge of the partition plate 43 is closed by partition wall 11 which separates the outside space 4*a* from the inside space 4*b*. The inside space 3*c* of the first tank element 3 communicates with outlet pipe 7.

The tube element 6 consists of three passages, namely a rear passage 61 which is the first coolant flow passage and is situated on the back side away from the air flow side, a center passage 62 which is a second coolant flow passage and a front passage 63 which is a third coolant flow passage and is situated on the front side. Each passage is defined by partition walls 10 which are integral with the tube element 6. Both end portions of the rear passage 61 project through partition plates 33, 43. Furthermore end portions of the other passages, the center passage 62 and the front passage 63 are within the partition plates 33, 43 and in the inside space 3*b*, 4*b*.

Each tube element 6 is formed to be flat and oblong by extrusion molding, and the length of the vertical sides is shorter than the length of the horizontal sides. The tube elements 6 and the fins 5, the tube elements 6 and the inside plates 32, 42, and the tube elements 6 and the partition plates 33, 43 are fixed by being brazed together. The brazing is done at the same time because all parts of the tank elements are formed of brazing sheet materials.

The partition plates 33, 43 are used for protecting the tank elements 3, 4 against the external force and pressure.

Figure 3:
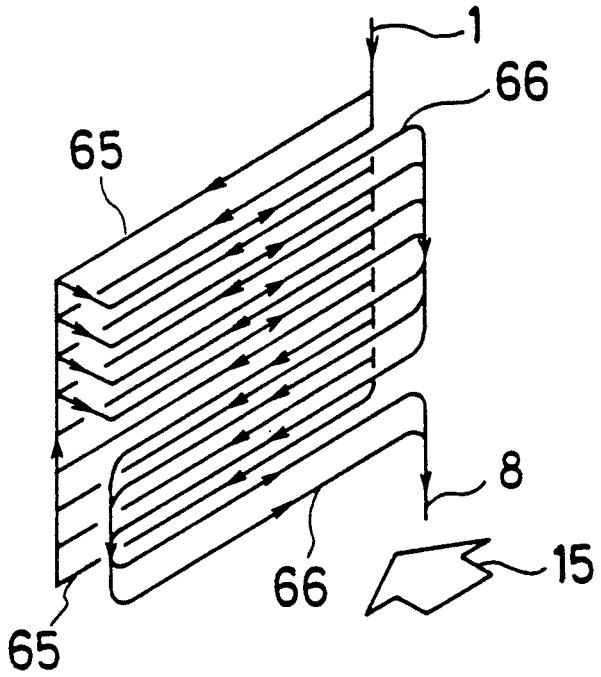
FIG. 3 is a schematic plan view showing coolant flow in the heat exchanger shown in FIG. 1.
Figure 4:
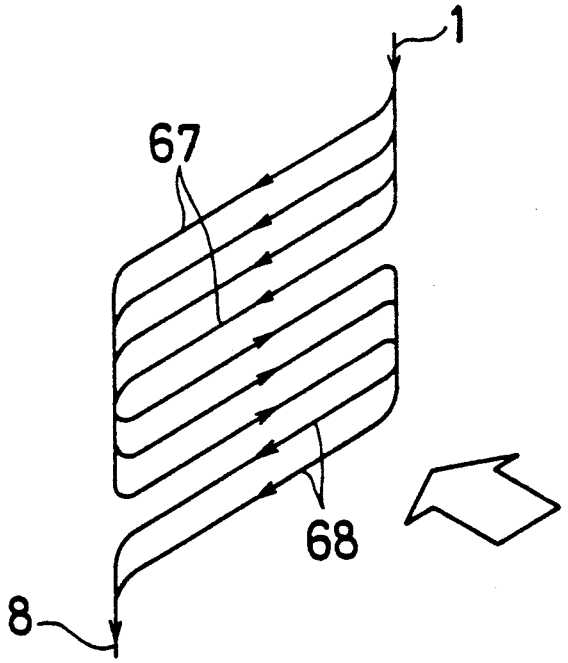
Fig. 4 PRIOR ART
FIG. 4 is a schematic plan view showing coolant flow in the heat exchanger according to the prior art.
Figure 5:
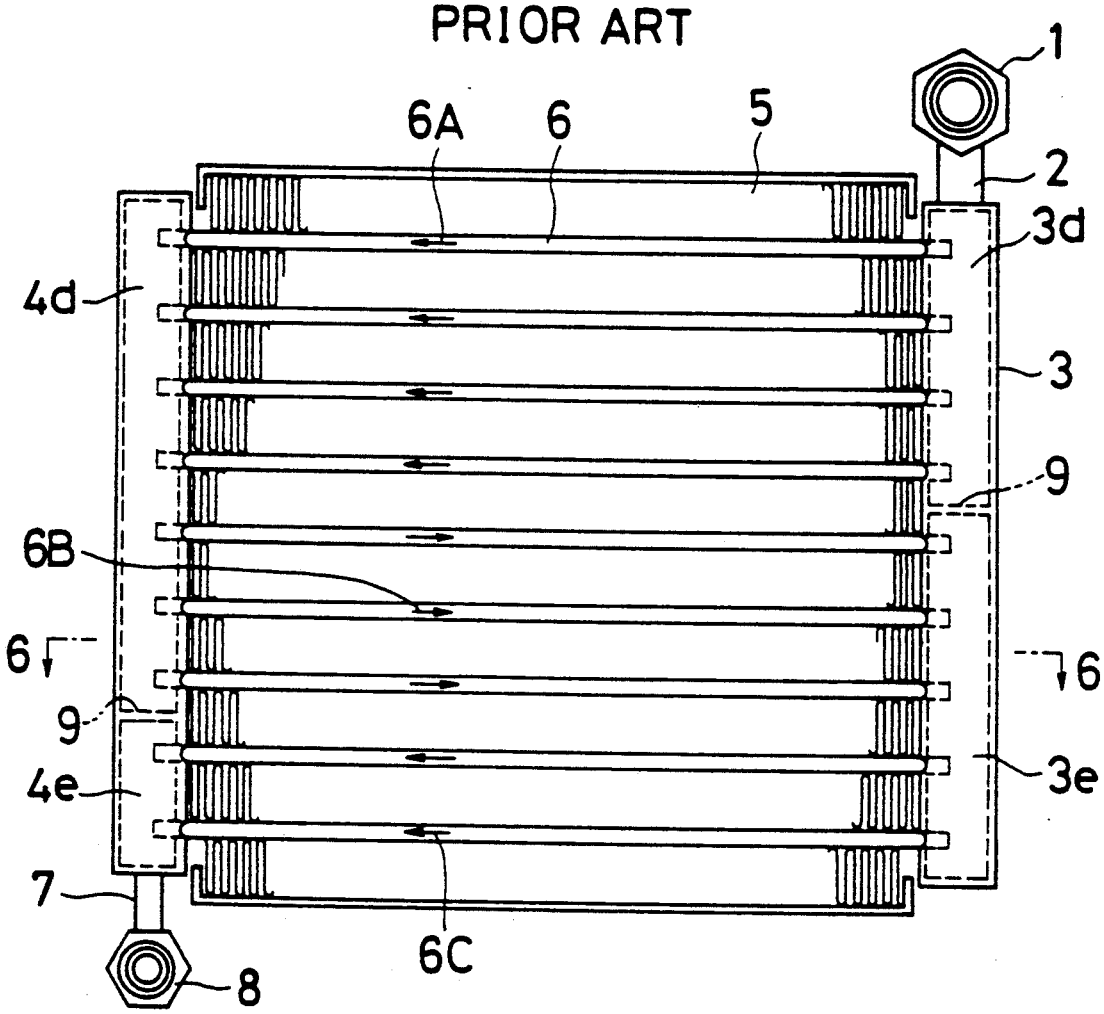
Fig. 5 PRIOR ART
Figure 6:
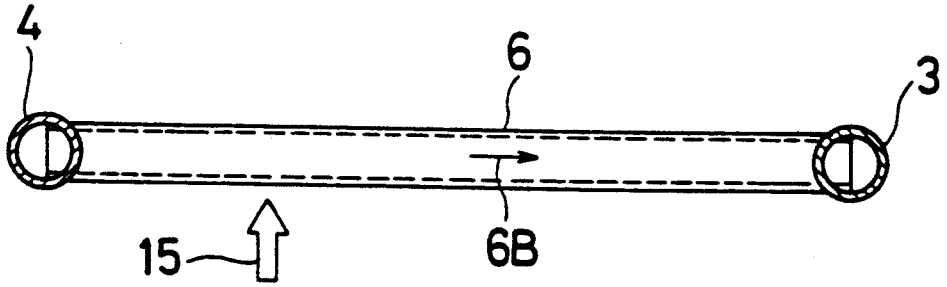
Fig. 6 PRIOR ART
FIG. 6 is a cross sectional view taking along line 6—6 in FIG. 5.

The direction of the coolant flow in the tube elements 6 is shown in FIGS. 2–4 with arrows. The coolant flow enters from the inlet tube 2 and flows from the outside space 3*a* of the first tank element 3 to the outside space 4*a* of the second tank element 4 through all the rear passages 61 of the tube elements 6 as shown by arrow 6A. After that the coolant flows from space 4*a* to the inside space 3*b* of the first tank element 3 through the center passages 62 and the front passages 63 of the upper four tube elements as shown by arrow 6B. The coolant then flows to the inside space 4*b* of the second tank element 4 through the center and front passages 62, 63 of the center three tube elements as shown by arrow 6C. It then flows to the inside space 3*c* of the first tank element 3 through the center and front passages 62, 63 of the lower two tube elements as shown by arrow 6D, and flows out from exit 8.

FIG. 3 shows the coolant flows in the heat exchanger in this embodiment and FIG. 4 shows the coolant flows in the conventional heat exchanger. In the case of this embodiment in FIG. 3, the temperature of the upper reaches of the coolant flows 65 which flow in the rear passages 61 is high. The temperature of the lower reaches of the coolant flows 66 which flow in the center and front passages 62, 63 is low, because the lower reaches of the coolant flows 66 have been cooled by the air flow. The temperature of the air flow in the front side is low, because the air flowing in the front side has not exchanged heat with the coolant flows. On the other hand, the temperature of the air flowing in the rear side is high, because the air in the rear side has already exchanged heat. Because of that structure, the difference in temperature between the coolant flow and the air flow is averaged between the air flow in the front side (the lower reaches of the coolant flows) and the air flow in the rear side (the upper reaches of the coolant flows). Thus the heat exchanger of this embodiment has a favorable formal character as an orthogonal type and performs favorably compared to the opposite flow type. So this heat exchanger can be of high efficiency.

In the case of the conventional heat exchanger, the temperature of the coolant flows 67 which are near entrance 1 is still high and the difference in the temperature between the coolant flows and the air flow is large enough. But the coolant flows 68 which are near the exit 8 have exchanged heat with the air flow, so that the difference in temperature between the coolant flows and the air flow is small and the amount of heat exchanged in this part is not enough. Therefore the orthogonal flow type conventional heat exchanger is of low efficiency. The heat exchanger in this embodiment solves that problem.

In the conventional heat exchanger, the tube elements which have a high difference in the temperature between the air flows and the coolant flows and are on the upper reaches of the coolant flows are increased. But diversification of the tube element has limits and increasing the number of the tube elements makes the sectional area of the coolant flows in the upper reaches too big, and makes the speed of the coolant slower. As a result, the efficiency of heat exchange is reduced.

But in this embodiment, the inner spaces of the tube elements are divided and the coolant flows of the upper and lower reaches are in each tube element so that the whole sectional area of the coolant flows can be controlled under a fixed area. Thus the speed of the coolant flows is not reduced no matter where the upper reaches of the coolant flows are arranged. The volume of the coolant flow becomes smaller as condensation and cooling occur, and the passages which are arranged in the front side opposite to the air flow are divided into three groups. The upper group has more passages than the lower group. In this embodiment, this structure of the passages and the averaging of the difference between the temperatures increases the efficiency of the heat exchange.

In the case of the heat exchanger of this embodiment, all of the tank elements are formed of brazing sheet material which is an alloy made of brazed aluminum, etc. So each plate which is formed as a partition plate, an inside plate, or an outside plate is brazed to the tube elements or each other without using brazing materials. This brazing work can be performed in the same furnace where the tube elements and the fins are brazed together. Thus, the time for the plates to be brazed is shortened and the cost of the heat exchange element is reduced so that the heat exchanger of this invention has a lower cost and a high efficiency.

Furthermore the holes in the partition plates are penetrated by the tube elements and they are fixed to each other by brazing. Thus the strength of the partition plate is improved and it can better resist pressure. On the second tank element, when the partition plate is placed from end to end and some penetration holes are formed and the inside space and the outside space of the tank element is created, the strength of the partition plate and the tank element is improved.

In this heat exchanger as mentioned above, the passages of the tube elements are divided into three passages, that is the front passage, the center passage and the rear passage, and each passage is guided to another space of the tank elements and each tube element includes the passages which goes to the space and back. But each tube element of the heat exchanger of this invention may comprise not only three passages but also two passages and/or more passages. Moreover the coolant flows in the tube elements can be opposite flows between the center passage and the front passage.

Obviously numerous modifications and variations of the present invention are possible in light of the above teachings. It is therefore to be understood that within the scope of the appended claims, the invention may be practiced otherwise than as specifically described herein.

What is claimed is:

1. A heat exchanger for performing a heat exchange between an air flow and a coolant flow comprising:

a plurality of tube elements;

a plurality of fins, said fins being alternately stacked with said tube elements;

a pair of tank elements disposed on opposite sides of said tube elements, one of said tank elements being formed of a brazing material and comprising a pair of plates shaped to form an inner space;

a partition plate which divides the inner space into a first space near said tube elements and a second space separated from said tube elements by said first space, said partition plate having a plurality of holes formed therein; and at least first and second coolant flow passages contained in each of said tube elements for receiving coolant that flows in a coolant flow direction, the first coolant flow passages extending through said holes and into said second space, and said second coolant flow passages extending into said first space.

2. A heat exchanger according to claim 1, wherein said tube elements are brazed to said tank elements, and said plates of said one tank element are brazed together, said tube elements and said tank elements being brazed together at the same time said plates of said one tank element are brazed together.

3. A heat exchanger as in claim 1, wherein said plates of said tank elements have a U shaped cross section.

4. A heat exchanger of claim 1, wherein one of said coolant flow passages of each of said tube elements is located further upstream with respect to the coolant flow direction than the other coolant flow passages of said tube element, said one coolant flow passage of each tube element being located further away from said air flow than the other coolant flow passages.

5. A heat exchanger for performing a heat exchange between an air flow and a coolant flow which flows in a coolant flow direction; comprising a plurality of tube elements;

a plurality of fins, said fins being alternately stacked with said tube elements;

a pair of tank elements which are disposed on opposite sides of said tube elements and which receive the coolant flow;

each of said tube elements including a first coolant flow passage which is on a rear side of said air flow, and a second coolant flow passage which is on a front side of said air flow, said second coolant flow passage being located downstream of said first coolant flow passage with respect to said coolant flow direction;

each of said first coolant flow passages being connected together through said tank elements so that all of said first coolant flow passages form one passage in parallel; and each of said second coolant flow passages being connected together through said tank elements and being divided into at least two groups each of which forms one passage in parallel with the other respectively, one of said groups of second coolant flow passages receiving coolant flow upstream of the other group of second coolant flow passages with respect to the coolant flow direction.

* * * * *